United States Patent [19]

Levit et al.

[11] Patent Number: 4,834,649

[45] Date of Patent: May 30, 1989

[54] RANDOM ACCESS OVEN

[75] Inventors: Boris Levit, Cupertino; Michael Millerick; Walter Soboszek, both of San Jose, all of

[73] Assignee: National Semiconductor Corporation, Santa Clara, Calif.

[21] Appl. No.: 197,986

[22] Filed: May 24, 1988

[51] Int. Cl.[4] ..... F27B 9/00

[52] U.S. Cl. ..... 432/121; 432/162; 432/124; 432/239; 432/243

[58] Field of Search ..... 532/239, 243, 124, 121, 532/87, 162

[56] References Cited

U.S. PATENT DOCUMENTS

| | | | |
|---|---|---|---|
| 1,900,903 | 3/1933 | Bennington | 432/243 |
| 2,907,858 | 10/1959 | Distler | 432/124 |
| 3,883,295 | 5/1975 | Lowdermann et al. | 432/239 |
| 4,276,465 | 6/1981 | Flavio | 432/239 |
| 4,421,481 | 12/1983 | Holz et al. | 432/239 |

*Primary Examiner*—Henry C. Yuen

*Attorney, Agent, or Firm*—Limbach, Limbach & Sutton

[57] ABSTRACT

A random access oven system including an oven, a vestibule, a loading conveyor, and a cooling conveyor. A plurality of load carriers, arranged in one or more tiers, are translated within the oven by one or more drive chains, in response to remotely generated commands. Loads to be treated in the oven are queued on the loading conveyor and are supplied to the vestibule in response to remotely generated commands. Any desired load carrier may be brought to a position adjacent the vestibule where the load carried by the carrier may be transferred to a conveyor within the vestibule, or a load within the vestibule may be transferred to the load carrier. After exiting the oven following heat-treatment, a load within the vestibule may be transferred onto the cooling conveyor. After a desired cooling period, each load on the cooling conveyor may be transferred out of the inventive system, for example to an adjacent conveyor. Any load may be removed from the oven after a desired time period, while all other loads remain in the oven. Thus, a variety of loads may simultaneously be subjected to different heat-treatments in the oven, with the constraint that all loads will be subjected to the same oven atmosphere and temperature while resident in the oven.

25 Claims, 4 Drawing Sheets

RANDOM ACCESS OVEN

FIELD OF THE INVENTION

This invention relates to a system including an oven and a remotely controlled loading/unloading mechanism for transporting materials into and out of the oven. More particularly, the invention relates to a system including an oven and a remotely controlled loading-/unloading conveyor apparatus for transporting selected loads into or out of the oven in a random fashion.

BACKGROUND OF THE INVENTION

Numerous conventional processes require that materials be treated in a specific atmosphere for a specific period of time at high temperature in an oven. Important examples of such processes include mold curing and die attachment of electronic components, such as integrated circuits.

Conventional oven systems have lacked practical "random access" capability, in the sense that they have not included practical means for removing selected load from an oven at desired times and for introducing selected loads into the oven at selected times, in response to remotely generated control signals. Rather, conventional oven systems have employed a conveyor belt to translate a stream of loads through an oven (so that the first load to enter the oven must exit the oven before the second load to enter the oven may exit the oven), or have required that batches of loads simultaneously enter the oven and thereafter, simultaneously exit the oven.

Further, conventional oven systems that employ a conveyor belt to translate a stream of loads through an oven have had bulky size, occupying large floor areas without realizing the floor space economies attainable by maximizing the use of vertical space above a given floor area.

Until the present invention, it was not known how to construct and operate systems for treatment of a plurality of loads in an oven in a manner eliminating the above-described disadvantages of conventional systems.

SUMMARY OF THE INVENTION

The inventive random access oven apparatus includes an oven, a vestibule, a loading conveyor, and a cooling conveyor. A plurality of load carriers are suspended from drive chains in the oven. The drive chains, when rotated in response to a remotely generated command, will translate the load carriers around a closed path within the oven. Loads to be treated in the oven (which may be trays of electronic components in various stages of assembly) are queued on the loading conveyor, and are supplied to the vestibule in response to remotely generated commands. Any desired load carrier may be brought to a position adjacent the vestibule (at any desired time). In such position, a load carried by the load carrier may be transferred to a conveyor within the vestibule, or a load within the vestibule may be transferred to the load carrier. After exiting the oven following heat-treatment, a load within the vestibule may be transferred onto the cooling conveyor. After a desired cooling period, each load on the cooling conveyor may be transferred out of the inventive system, for example to an adjacent conveyor.

In a preferred embodiment, the walls of the vestibule include three remotely-controllable doors, one opening to the oven, one to a loading chamber (including the loading conveyor), and one to a cooling chamber (including the cooling conveyor). Only one of the doors is normally open at any instant during operation of the system, although all doors may be closed when desired. This allows maintenance of a desired controlled atmosphere within the oven and allows purging of undesired gas from the vestibule before gaseous communication is enabled between the vestibule and the oven.

In one embodiment, the load carriers are all positioned at substantially the same vertical level. In a preferred embodiment, one tier of load carriers is positioned above (or below) a second tier of load carriers. A first set of drive chains translate the first tier of load carriers generally horizontally through the oven, a second set of drive chains translate the second tier of load carriers generally horizontally through the oven, and a loading/unloading mechanism including an elevator introduces loads to either the first tier or second tier of carriers and removes loads from either tier of carriers.

DETAILED DESCRIPTION OF THE PREFERRED EMBODIMENTS

Figure 1:
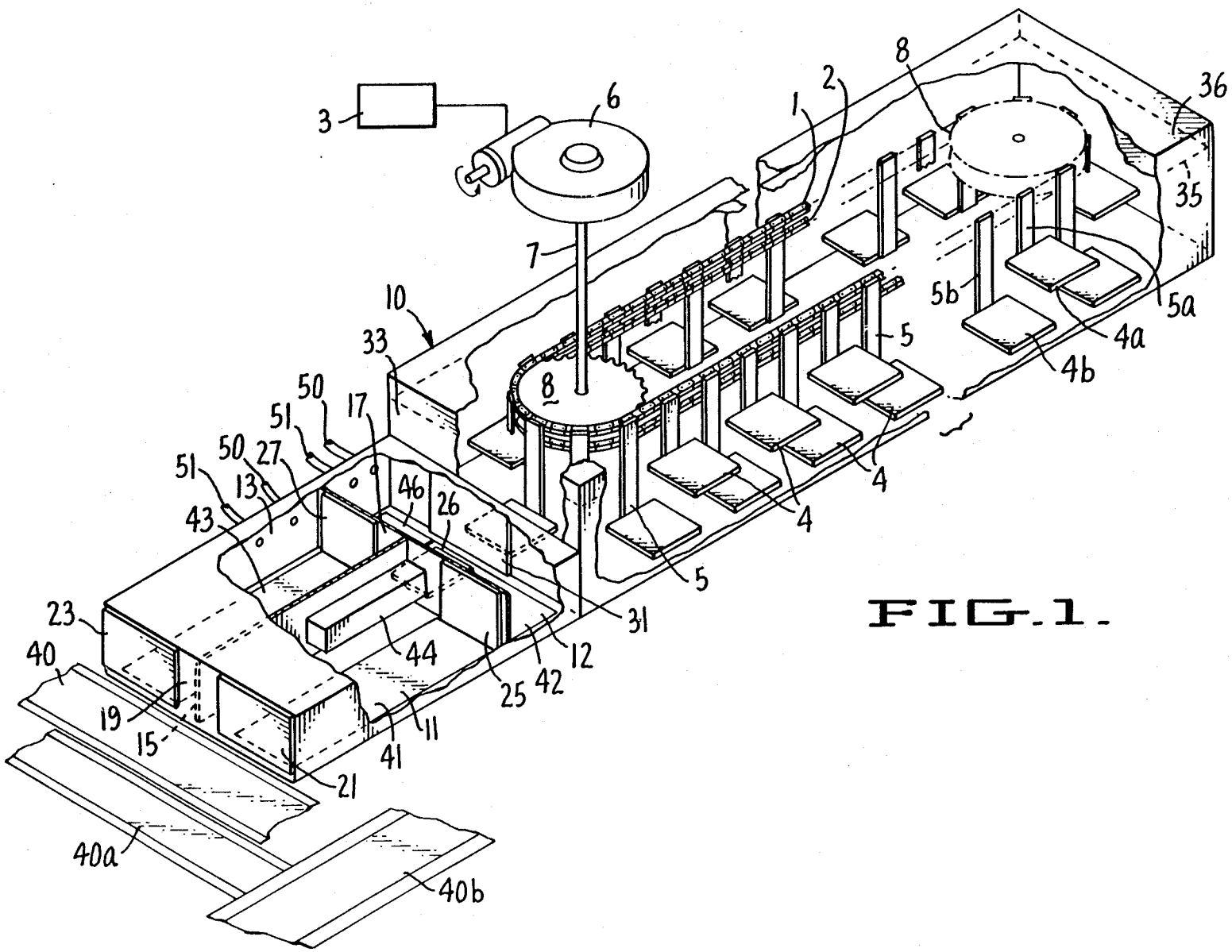
FIG. 1 is a simplified perspective view of a preferred embodiment of the inventive system.

One preferred embodiment of the invention will be described with reference to FIG. 1. Drive chains 1 and 2 are each oriented in a substantially horizontal plane. Each is driven in a substantially horizontal path by drive sprockets 8, which are dimensioned to engage the links of chains 1 and 2. One or more of sprockets 8 are rotated by shaft 7, which is powered by a conventional power source (not shown) through gear box 6. In response to remotely generated control signals from machine control unit 3, gear box 6 may be operated to rotate sprockets 8 in a clockwise or a counterclockwise direction, or may be decoupled from the sprockets so that drive chains 1 and 2 remain stationary. A plurality of load carriers 4 are attached to each of chains 1 and 2. As drive sprockets 8 rotate chains 1 and 2, load carriers 4 are translated along a path in a substantially horizontal plane.

A load, such as load 26, may be automatically transported by transfer mechanism 44 into oven 10 through 31, and placed on the load carrier adjacent door 31. Similarly, transfer mechanism 44, in response to a control signal from machine control unit 3, removes a load from the load carrier nearest door 31 and places the load on a conveyor (to be described with reference to FIG. 2) within vestibule 12. The load, which typically will have very high temperature, will then be transported through door 27 into cooling chamber 13.

Loads from conveyor 40 are transferred into loading chamber 11 through door 21 in end wall 19 by any convenient means (not regarded as part of the invention and not shown in FIG. 1). In chamber 11, the loads form a queue on loading conveyor 41 (sometimes also referred to herein as "queuing" conveyor 41). In response to control signals from machine control unit 3, loading conveyor advances the queued loads toward door 25, and through door 25 onto vestibule load conveyor 42 (to be discussed below with reference to FIG. 2) within vestibule 12.

Loads emerging from door 27 into cooling chamber 13 are queued on cooling conveyor 43. The loads remain in cooling chamber 13 until conveyor 43 advances them in response to control signals from machine control unit 3. The control signals are timed so that each load will have cooled to an acceptably low temperature so that it may be released through door 23 in end wall 19 onto conveyor 40. From conveyor 40, the heat-treated, cooled loads may be transferred to other conveyors such as spur conveyor 40*a* and main conveyor 40*b*.

The design of the inventive system allows each load on one of load carriers 4 to remain resident in oven 10 for any desired time period. In response to control signals from machine unit 3, at a desired moment any desired load carrier is translated by drive chains 1 and 2 to door 31 for unloading. Thus, a variety of loads may simultaneously be subjected to different heat-treatment times in the oven, with the constraint that all loads will be subjected to the same oven atmosphere and temperature while resident in the oven.

Each door of the inventive system is of the type that may be operated in response to signals from a remote control unit such as machine control unit 3. When each door is open, a load may be passed through the passage defined thereby. When each door is closed, not only will the door block passage of a load, but the door will prevent significant amounts of gas from escaping through the passage blocked by the door.

Preferably, door 31 (when closed) and the walls of oven 10 will provide thermal insulation and prevent significant gas leaks between the interior and exterior of oven 10. Typically, for mold curing or die attachment heat treatments for electronic components, the atmosphere within oven 10 will be nitrogen or clean, dry air, and the maximum oven temperature will be approximately 262° C.

Preferably, the control signals from machine unit 3 will be generated with the constraint that no more than one of doors 25, 27, and 31 will be in an open configuration at any instant. Thus, the oven atmosphere will not be polluted by undesired gas entering from chamber 11 or 13. We prefer that both vestibule 12 and cooling chamber 13 include gas purging means, such as gas inlet 50 and gas outlet 51, to control the atmosphere therein. Vestibule 12 is purged during the operation of loading the oven, in a manner to be described below. In a preferred embodiment, after a load has entered cooling chamber 13, door 27 is closed and chamber 13 is purged by gas flow through gas inlet 50 and gas outlet 51 to introduce a desired atmosphere into chamber 13. The loads within purged cooling chamber 13 may thus cool while exposed to the desired atmosphere until conveyor 43 advances them through door 23 in response to control signals from machine control unit 3.

Given the description of the inventive system and its method of operation prescribed herein, one of ordinary skill in the art of automatic conveyor system control will be able readily to construct a machine control unit capable of generating appropriate control signals for the various system components in response to command signals from a host computer connected to the machine control unit. Similarly, an ordinarily skilled computer programmer will be able readily to program such host computer to supply such command signals in response to a set of operating parameters input by a system operator.

Figure 2:
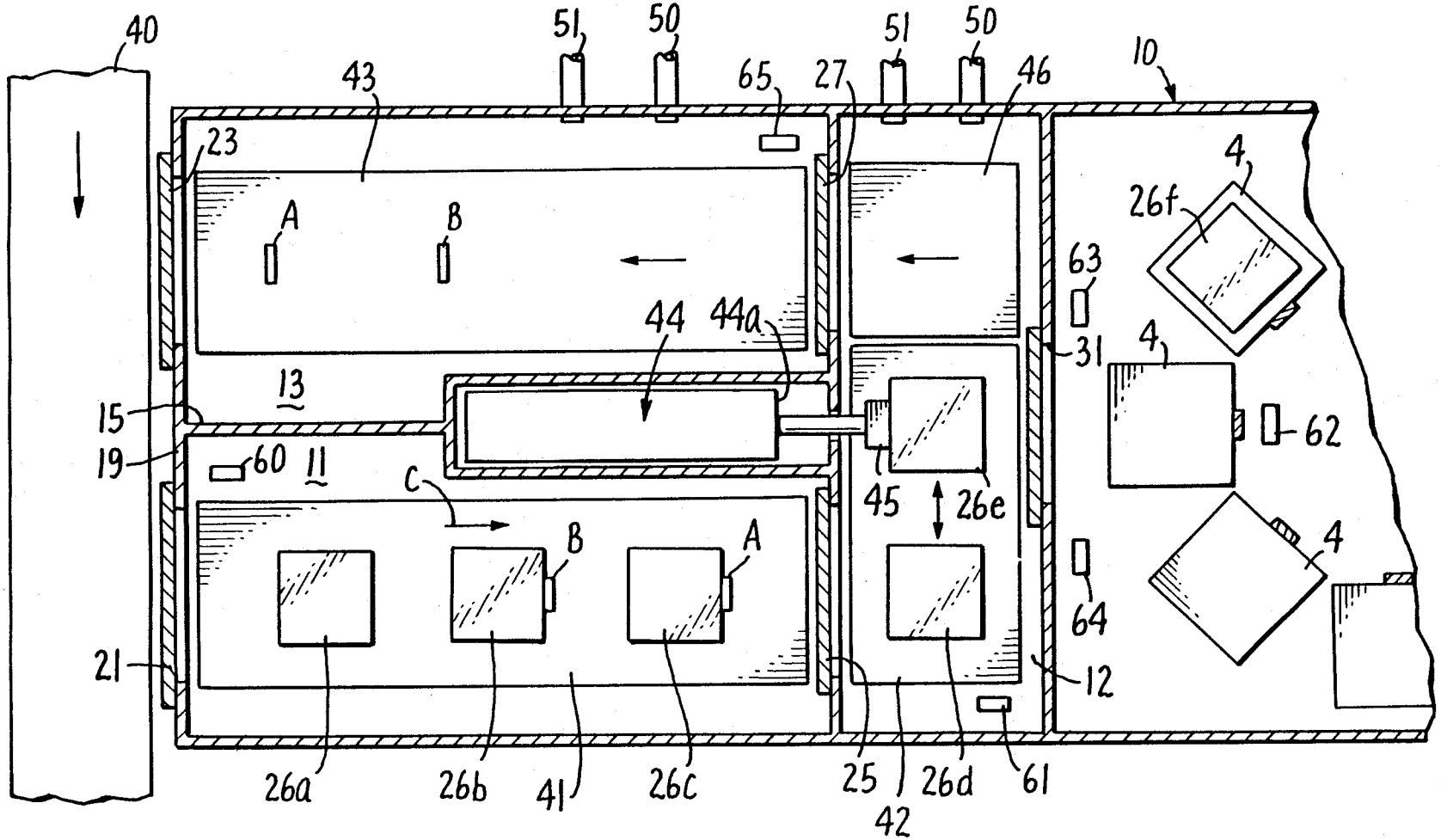
FIG. 2 is a cross-sectional view, in a horizontal plane, of the portion of the FIG. 1 system which transports loads into and out from the oven of the FIG. 1 system.

The structure and manner of operation of the FIG. 1 system will now be described in greater detail with reference to FIG. 2. FIG. 2 is a cross-sectional view, in a horizontal plane, of the loading chamber, cooling chamber, vestibule, and a portion of the oven of the FIG. 1 system. The portion of oven 10 shown in FIG. 2 includes four load carriers 4, one of which carries load 26*f*. Sensor 60 counts the loads entering loading chamber 11 through door 21 and supplies this information to machine control unit 3 ("MCU" 3) so that MCU 3 will know how many loads are queued on loading conveyor 41. Loads 26*a*, 26*b*, and 26*c* are shown queued on conveyor 41. An escapement mechanism including members A and B is provided at the discharge end of each of conveyors 41 and 43 (i.e., at the end of conveyor 41 near door 25, and at the end of conveyor 43 near door 23). Member A or B (or both members A and B) may be raised to prevent passage of the load immediately upstream therefrom. For example, when conveyor 41 is operating (to translate loads in the direction of arrow C), raised members A and B prevent loads 26*c* and 26*b* respectively from translating toward door 25. When member A is lowered, load 26will be translated by conveyor 41 through door 25 onto vestibule load conveyor 42. Each escapement mechanism thus allows release of single loads into vestibule 12 or onto conveyor 40 at desired times. Members A and B may be raised and lowered by any conventional, remotely-controllable means.

Loads 26*d* and 26*e* are supported on conveyor 42 in vestibule 12. Conveyor 42 operates reversibly, to translate the loads either toward the top of FIG. 2 or toward the bottom of FIG. 2, in response to signals from MCU 3. When a load passes through door 25 onto conveyor 42, it is detected by sensor 61 (similarly, when a load passes through door 27, it is detected by sensor 65). After conveyor 42 translates a load to the position of load 26*e*, transfer mechanism 44 may be operated to transfer the load through door 31 onto one of load carriers 4 within oven 10. In the embodiment shown in FIG. 2, arm 45 of mechanism 44 will engage with load 26*e* and extend outward from portion 44*a* of mechanism 44 to translate the load onto the nearest load carrier 4.

To remove a load from the oven, the proper load carrier is brought into position adjacent door 31, and arm 45 of mechanism 44 engages with the load and pulls it through door 31 onto conveyor 42. Then, conveyor 42 is operated to transport the load onto unloading conveyor 46, which is in turn operated to transport the load through door 27 onto cooling conveyor 43.

There are two specific operating sequences for loading oven 10, known as the initial loading sequence and the operational loading sequence. The initial loading sequence is performed until all carriers in the oven have been filled, or until it is desired to remove a load from the oven, whichever occurs first. During a preferred version of the initial loading sequence, pairs of consecutive loads are placed in the vestibule as rapidly as possible, to minimize the number of vestibule purging operations required. After the first load in each pair is positioned on vestibule load conveyor 42, and while door 25 remains open, the first load is conveyed to a position adjacent oven door 31 and the escapement mechanism of loading chamber 11 releases the second load which is transported by conveyor 41 onto conveyor 42, where it is sensed by sensor 61. Door 25 is then closed, vestibule 42 is purged by gas inlet 50 and gas outlet 51 so that the atmosphere within vestibule 42 matches that within oven 10, and the vestibule temperature is raised to a nominal temperature (which depends on the oven temperature). Door 31 is then opened, and transfer mechanism 44 transfers the first load onto a load carrier and retracts. Then, a new load carrier is brought into position adjacent door 31 while conveyor 42 translates the second load into position adjacent door 31. Preferably the loads are not placed on consecutive load carriers, but instead on evenly separated load carriers (for example, on every Nth carrier within the oven) to ensure more even temperature distribution within the oven. There may be any number of load carriers 4 within the oven. Mechanism 44 then transfers the second load onto the adjacent load carrier, and door 31 will then close. The described steps may then be repeated.

The second type of loading sequence, the "operational" loading sequence, is performed in two contexts: first, when it is desired to remove a load from the oven and substitute a new load therefor; and second, when sensors within the oven (such as sensors 62, 63, and 64) detect the existence of an empty load carrier. In either case, MCU 3 generates an appropriate signal requesting a load from load conveyor 41. In response to this signal, door 25 will open, conveyors 41 and 42 will run, and escapement mechanism AB will release a load from conveyor 41. The escapement mechanism will then be switched into a position allowing the queued loads on conveyor 41 to advance. The vestibule door 25 will close when sensor 61 detects the arrival of the new load onto conveyor 42, and the vestibule will be purged. After purging is complete, either the load is transferred into the empty carrier in the oven, or the desired load (whose heat treatment has been completed) is removed from the oven and transported onto conveyor 46. In the latter case, the new load is transferred onto the recently vacated carrier after the heat treated load has been transferred to conveyor 46.

When a particular load has been resident in the oven for a desired period, MCU will instruct drive chains 1 and 2 to move the load's carrier to the oven door via the shortest route. The oven door will open, and transfer mechanism 44 will extend into the oven to engage with the load and pull it into the vestibule. The oven door will close, mechanism 44 will retract, and the load will be conveyed to conveyor 46.

When no further loading is to occur, such as at the end of a product run or in an emergency situation, unloading may be performed more rapidly by unloading two loads from the oven between vestibule purging operations.

MCU 3 receives signals from the load sensing sensors (such as sensors 60–65) distributed throughout the system. The MCU is also supplied with instructions as to the desired oven residence time period for each load. MCU 3 processes this information, to determine the identity of each load that has been loaded on each carrier, the current position of each carrier, and the appropriate time for removing each load from the oven. Loads may be randomly loaded into and removed from the oven.

In a preferred embodiment, sensors 62, 63, and 64 at the oven entrance perform the following functions. Sensor 62 senses whether or not a load resides on the carrier adjacent oven door 31. Sensor 63 senses a characteristic portion of each carrier (such as the carrier's leading edge or a tab on each carrier) for accurate positioning of the carrier relative to the door for loading or unloading. For example, if the MCU commands the nth carrier to move to door 31, when the (n−1)th carrier has passed door 31, MCU 3 will command the motor powering drive chains 1 and 2 to decelerate, monitor the signal produced by sensor 63, and will shut off the motor (and optionally apply brakes on the drive shaft 7) when sensor 63 detects the characteristic portion of the nth carrier.

Sensor 64 senses a characteristic of one of the carriers (referred to as the "first" carrier) that distinguishes that carrier from all the others. Thus, in the event of a power failure or the like which has caused MCU to lose track of the identity of each carrier, the signal from sensor 64 allows MCU 3 to reestablish the carriers' identities.

Figure 3A:
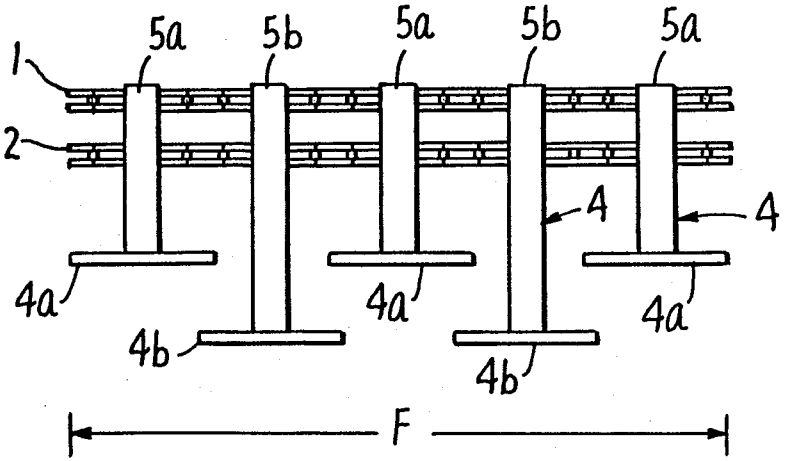
FIG. 3A is a side view of a preferred embodiment of five load carriers for transporting loads within the oven of the inventive system.

FIG. 3A is a side view of five of the carriers 4 suspended from drive chains 1 and 2 in oven 10 of the FIG. 1 embodiment. Chain 1 rotates in a generally horizontal plane vertically above the plane in which chain 2 rotates. Each carrier 4 (in both FIG. 3A and FIG. 3B) includes a hanger member (5*a*, 5*b* or 5*c*) and a tray (4*a*, 4*b*, or 4*c*). The hanger member of each carrier 4 is attached to both chains 1 and 2, for enhanced stability. In FIG. 3A, the hanger members (5*a* and 5*b*) include a subset of shorter members 5*a* and a subset of longer members 5*b*. Accordingly, trays 4*a* and 4*b* of each pair of adjacent carriers 4 are staggered at different vertical levels.

Figure 3B:
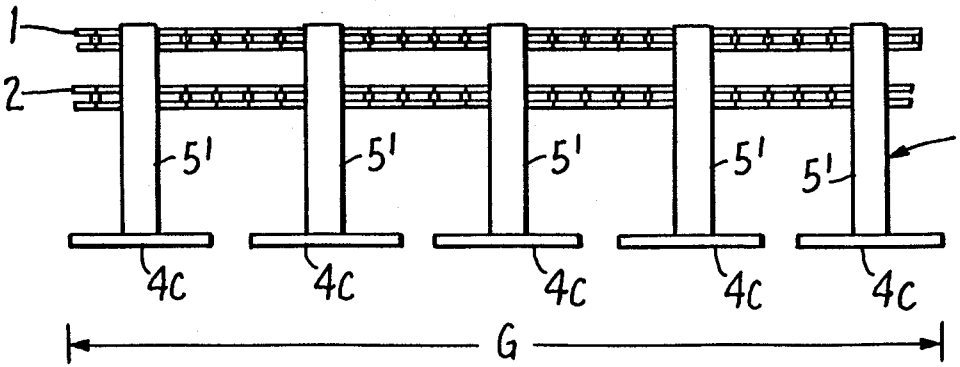
FIG. 3B is a side view of an alternative embodiment of five load carriers for transporting loads within the oven of the inventive system.

FIG. 3B is a side view of five carriers 4 in a variation on the FIG. 3A embodiment. As in FIG. 3A, each carrier 4 includes a tray (4*c*) and a hanger member (5') suspended from chains 1 and 2. However, hanger portions 5' in FIG. 3B have substantially identical lengths so that all of the trays 4*c* are at substantially the same vertical level. The FIG. 3A configuration has the advantage that it allows carriers 4 to be suspended with greater density in the oven. This advantage is suggested by FIGS. 3A and 3B, in which distance F spanned by the five carriers of FIG. 3A is less than distance G spanned by the five similar carriers of FIG. 3B. The inventors recognize that there are numerous possible variations on the configurations of FIG. 3A and FIG. 3B.

Figure 4:
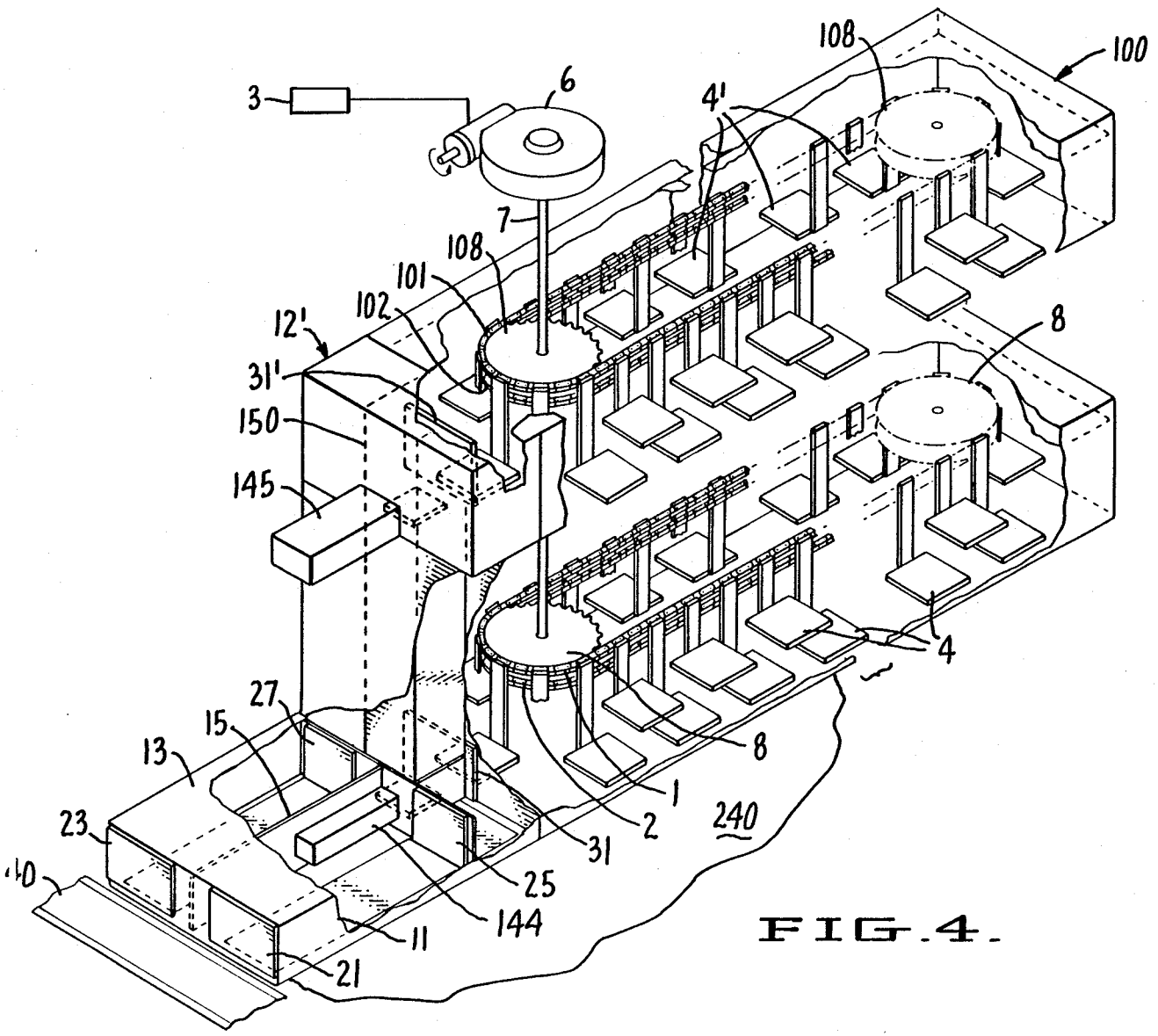
FIG. 4 is a simplified perspective view of an alternative preferred embodiment of the inventive apparatus.

FIG. 4 is a simplified perspective view of an alternative preferred embodiment of the invention. The FIG. 4 apparatus is a two-tiered version of the FIG. 1 apparatus, and includes a first tier of load carriers (of the type shown in FIG. 1) attached to drive chains 1 and 2, and a second tier of load carriers attached to drive chains 101 and 102. The two-tiered configuration of the FIG. 4 embodiment is particularly advantageous because it minimizes the area of floor 240 occupied by the oven for a given number of product carriers.

The FIG. 4 system differs from the FIG. 1 system in only a few respects. Oven 100 of FIG. 4 has lower door 31 and upper door 31'. Vestibule 12' of the FIG. 4 system includes elevator 150 and two transfer mechanisms 144 and 145. Each of transfer mechanisms 144 and 145 operates in the same manner as does mechanism 44 of FIG. 1 in order to introduce loads to (and remove loads from) one of the tiers of load carriers.

When a load has entered vestibule 12' from loading chamber 11, the MCU 3 directs elevator 150 to the level of the lower tier to receive the load. Transfer mechanism 144 may then transfer the load to one of carriers 4 in the lower tier. Alternatively, elevator may carry the load up to the level of upper oven door 31', at which level mechanism 145 may transfer the load to a carrier in the upper tier.

In the oven of any of the inventive embodiments described herein, the drive chains may be disposed above the load carriers as shown in FIG. 1 (so that each load carriers hang from the drive chains), or the drive chains may be disposed below the load carriers (so that each load carrier is supported above a drive chain by a rigid member attached to the drive chain).

Various other modifications and alterations in the structure and method of operation of this invention will be apparent to those skilled in the art without departing from the scope of this invention. Although the invention has been described in connection with specific preferred embodiments, it should be understood that the invention as claimed should not be unduly limited to such specific embodiments.

What is claimed is:

1. An oven system, including:

an oven;

a first group of load carriers translatably mounted within the oven;

a first transfer mechanism capable of transferring a load onto each load carrier in the first group and capable of removing a load from each load carrier in the first group;

conveyor means for supplying loads to the first transfer mechanism for transfer into the oven;

a first reversible drive means, operable in a first mode for translating any one of the load carriers in the first group in a forward direction to a position adjacent the first transfer mechanism, and operable in a second mode for translating any one of the load carriers in the first group in a reverse direction to a position adjacent the first transfer mechanism.

2. The system of claim 1, also including a vestibule from which the first transfer mechanism transfers loads into the oven, and wherein the conveyor means includes;

a first conveyor for conveying loads into the vestibule; and a second conveyor, housed in the vestibule, for receiving loads from the first conveyor and supplying them to the first transfer mechanism.

3. The system of claim 2, also including a first escapement mechanism coupled with the first conveyor and capable of releasing a single load from the first conveyor to the second conveyor, while preventing other loads on the first conveyor from advancing to the second conveyor.

4. The system of claim 2, also including:

a cooling conveyor; and means for transferring loads from the first transfer mechanism to the cooling conveyor.

5. The system of claim 1, also including:

a cooling conveyor; and means for transferring loads from the first transfer mechanism to the cooling conveyor.

6. The system of claim 1, wherein the adjacent load carriers in the first group of load carriers are mounted so as to be vertically spaced.

7. An oven system, including:

an oven;

a first group of load carriers translatably mounted within the oven;

a first transfer mechanism capable of transferring a load onto each load carrier in the first group and capable of removing a load from each load carrier to the first group;

a vestibule from which the first transfer mechanism transfers loads into the oven;

conveyor means for supplying loads to the first transfer mechanism for transfer into the oven, including a first conveyor for conveying loads into the vestibule, and a second conveyor, housed in the vestibule, for receiving loads from the first conveyor and supplying them to the first transfer mechanism; and a first drive means for translating any one of the load carriers in the first group to a position adjacent the first transfer mechanism;

a cooling conveyor;

means for transferring loads from the first transfer mechanism to the cooling conveyor;

a loading chamber housing the first conveyor;

a cooling chamber housing the cooling conveyor;

first sealing means capable of being operated to prevent gas from flowing between the vestibule and the oven;

second sealing means capable of being operated to prevent gas from flowing between the vestibule and the loading chamber; and third sealing means capable of being operated to prevent gas from flowing between the vestibule and the cooling chamber, where the first sealing means, the second sealing means, and the third sealing means are independently operable.

8. The system of claim 7, wherein the vestibule also includes means for purging gas from the vestibule while the first sealing means, the second sealing means, and the third sealing means are operated to prevent gas flow from the vestibule to the oven and the loading and cooling chambers.

9. The system of claim 7, wherein the cooling chamber includes means for purging gas from the cooling chamber while the third sealing means is operated to prevent gas flow between the vestibule and the cooling chamber.

10. An oven system, including:

an oven;

a first group of load carriers translatably mounted within the oven;

a first transfer mechanism capable of transferring a load onto each load carrier in the first group and capable of removing a load from each load carrier in the first group;

conveyor means for supplying loads to the first transfer mechanism for transfer into the oven;

a first drive means for translating any one of the load carriers in the first group to a position adjacent the first transfer mechanism;

a cooling conveyor;

means for transferring loads from the first transfer mechanism to the cooling conveyor; and an escapement mechanism coupled with the cooling conveyor and capable of releasing a single load to advance along the cooling conveyor, while preventing other loads on the cooling conveyor from advancing.

11. An oven system, including:

an oven;

a first group of load carriers translatably mounted within the oven;

a first transfer mechanism capable of transferring a load onto each load carrier in the first group and capable of removing a load from each load carrier in the first group;

conveyor means for supplying loads to the first transfer mechanism for transfer into the oven;

a first drive means for translating any one of the load carriers in the first group to a position adjacent the first transfer mechanism;

a cooling conveyor;

means for transferring loads from the first transfer mechanism to the cooling conveyor;

wherein the means for transferring loads from the first transfer mechanism to the cooling conveyor includes an unloading conveyor.

12. An oven system, including:

an oven;

a first group of load carriers translatably mounted within the oven;

a first transfer mechanism capable of transferring a load onto each load carrier in the first group and capable of removing a load from each load carrier in the first group;

conveyor means for supplying loads to the first transfer mechanism for transfer into the oven;

a first drive means for translating any one of the load carriers in the first group to a position adjacent the first transfer mechanism;

a second group of load carriers translatably mounted in the oven;

a second transfer mechanism capable of transferring a load carrier in the second group and capable of removing a load from a load carrier in the second group; and a second drive means for translating any one of the load carriers in the second group to a position adjacent the second transfer mechanism.

13. The system of claim 12, wherein the load carriers in the second group comprise an upper tier of carriers and the load carriers in the first group comprise a lower tier of carriers, and also including:

a vestibule from which the first transfer mechanism and the second transfer mechanism transfer loads into the oven; and an elevator for transferring loads to the second transfer mechanism.

14. An oven system, including:

an oven;

a first group of load carriers translatably mounted within the oven;

a loading chamber;

a cooling chamber;

a vestibule;

a vestibule loading conveyor housed in the vestibule;

a first transfer mechanism capable of transferring a load from the vestibule conveyor onto each load carrier in the oven and capable of transferring a load from each load carrier to the vestibule loading conveyor;

a loading conveyor housed within the loading chamber and capable of supplying loads to the vestibule loading conveyor;

a cooling conveyor housed within the cooling chamber and capable of receiving loads from the vestibule; and a first drive means for translating any one of the load carriers in the first group along a generally horizontal path in the oven, to a position adjacent the first transfer mechanism.

15. The system of claim 14, wherein the first drive means is capable of reversibly translating each load carrier in the first group in either a forward direction or a reverse direction.

16. The system of claim 14, also including:

a second group of load carriers translatably mounted in the oven;

a second transfer mechanism capable of transferring a load onto a load carrier in the second group and capable of removing a load from a load carrier in the second group; and a second drive means for translating any one of the load carriers in the second group along a generally horizontal path to a position adjacent the second transfer mechanism.

17. The system of claim 16, wherein the load carriers in the second group comprise an upper tier of carriers and the load carriers in the first group comprise a lower tier of carriers, and also including:

a vestibule from which the first transfer mechanism and the second transfer mechanism transfer loads into the oven; and an elevator for transferring loads to the second transfer mechanism.

18. An oven system, including:

an oven;

a first group of load carriers translatably mounted within the oven;

a loading chamber;

a cooling chamber;

a vestibule;

a vestibule loading conveyor housed in the vestibule;

a first transfer mechanism capable of transferring a load from the vestibule conveyor onto each load carrier in the oven and capable of transferring a load from each load carrier to the vestibule loading conveyor;

a loading conveyor housed within the loading chamber and capable of supplying loads to the vestibule loading conveyor;

a cooling conveyor housed within the cooling chamber and capable of receiving loads from the vestibule;

a first drive means for translating any one of the load carriers in the first group along a generally horizontal path in the oven, to a position adjacent the first transfer mechanism, in response to a remotely generated control signal; and a machine control unit coupled to the first drive means and capable of generating the control signal.

19. The system of claim 18, also including a first escapement mechanism coupled with the loading conveyor and capable of releasing a single load from the loading conveyor to the vestibule loading conveyor, while preventing other loads on the loading conveyor from advancing to the vestibule loading conveyor.

20. The system of claim 18, also including a first sensor capable of detecting the presence of each load entering the loading conveyor.

21. The system of claim 18, also including a second sensor disposed in the oven adjacent the first load detector and capable of generating a signal indicative of the presence of each load carrier as said each load carrier translates past the second sensor.

22. The system of claim 21, wherein a first load carrier in the first group has a identifiable feature distinguishing it from the other load carriers in the first group, and also including:

a third sensor disposed in the oven adjacent the first load detector and capable of generating a signal indicative of the presence of said first load carrier as said first load carrier translates past the third sensor.

23. The system of claim 22, wherein the second sensor and the third sensor are coupled to the machine control unit in a manner so that the machine control unit receives each signal generated by the second sensor and the third sensor.

24. The system of claim 22, also including a fourth sensor disposed in the oven and capable of generating a signal indicative of the presence of a load on each load carrier as said each load carrier translates through a position adjacent the first transfer mechanism.

25. The system of claim 24, wherein the fourth sensor is coupled to the machine control unit in a manner so that the machine control unit receives each signal generated by the fourth sensor.

* * * * *